US009280934B2

(12) United States Patent
Kawabe

(10) Patent No.: US 9,280,934 B2
(45) Date of Patent: Mar. 8, 2016

(54) ELECTROLUMINESCENT DISPLAY DEVICE WITH COMBINED ANALOG AND DIGITAL DRIVING

(71) Applicant: Global OLED Technology LLC, Herndon, VA (US)

(72) Inventor: Kazuyoshi Kawabe, Tokyo (JP)

(73) Assignee: Global OLED Technology LLC, Herndon, VA (US)

( * ) Notice: Subject to any disclaimer, the term of this patent is extended or adjusted under 35 U.S.C. 154(b) by 0 days.

(21) Appl. No.: 14/623,905

(22) Filed: Feb. 17, 2015

(65) Prior Publication Data

US 2015/0161945 A1 Jun. 11, 2015

Related U.S. Application Data

(63) Continuation of application No. 14/180,432, filed on Feb. 14, 2014, now abandoned, which is a continuation of application No. 12/741,191, filed as application No. PCT/US2008/012297 on Oct. 30, 2008, now abandoned.

(30) Foreign Application Priority Data

Nov. 9, 2007 (JP) ..... 2007-291413

(51) Int. Cl.
*G09G 3/32* (2006.01)
*G09G 3/20* (2006.01)

(52) U.S. Cl.
CPC ..... *G09G 3/3275* (2013.01); *G09G 3/2022* (2013.01); *G09G 3/2081* (2013.01); *G09G 3/3233* (2013.01); *G09G 3/3258* (2013.01); *G09G 2300/0828* (2013.01); *G09G 2300/0842* (2013.01); *G09G 2310/027* (2013.01); *G09G 2330/021* (2013.01); *G09G 2330/023* (2013.01); *G09G 2360/12* (2013.01)

(58) Field of Classification Search
CPC . G09G 3/2022; G09G 3/2081; G09G 3/3233; G09G 3/3258; G09G 3/3275; G09G 2310/027; G09G 2330/02; G09G 2330/023; G09G 2360/12; G09G 2300/0828; G09G 2300/0842
See application file for complete search history.

(56) References Cited

U.S. PATENT DOCUMENTS 6,104,365 A * 8/2000 Towler ..... G09G 3/2011 345/89
2003/0160746 A1* 8/2003 Yamazaki ..... G09G 3/32 345/82
2004/0090446 A1* 5/2004 Lee ..... G09G 3/2081 345/690
2007/0279359 A1* 12/2007 Yoshida ..... G09G 3/2025 345/89

* cited by examiner

*Primary Examiner* — Ryan A Lubit
(74) *Attorney, Agent, or Firm* — Global OLED Technology LLC

(57) ABSTRACT

To reduce the number of sub-frames and perform high resolution display with low power consumption, each of the pixels has a digital emission period Td and an analog emission period Ta, and is driven in a time-divided fashion in a digital manner or in an analog manner. Each of the pixels performs high resolution display when being driven in an analog manner, and performs display with low power consumption when being driven in a digital manner.

4 Claims, 6 Drawing Sheets

ELECTROLUMINESCENT DISPLAY DEVICE WITH COMBINED ANALOG AND DIGITAL DRIVING

CROSS-REFERENCE TO RELATED APPLICATIONS

This application is a continuation of U.S. patent application Ser. No. 14/180,432, filed on Feb. 14, 2014, which is a continuation of U.S. patent application Ser. No. 12/741,191, filed Sep. 21, 2010 entitled "DISPLAY DEVICE" by Kazuyoshi Kawabe, which is a National Stage Entry of International Application No. PCT/US2008/012297, filed Oct. 30, 2008, and claims the benefit of JP 2007-291413 filed on Nov. 9, 2007, which are hereby incorporated by reference for all purposes as if fully set forth herein.

FIELD OF THE INVENTION

The present invention relates to a display device having pixels arranged in a matrix.

BACKGROUND OF THE INVENTION

An organic EL display is self-emissive and thus adapted to high contrast and quick response, and therefore appropriately used in a motion picture application, such as for a television and so forth, which shows a natural image. The organic EL element attains multi-level tones, or gradation, by driving using a constant current via a control element such as a transistor or the like or by driving using a constant voltage and changing the light emission period.

In driving using a constant current, the transistor operates in a saturation region, consuming a larger amount of power. Therefore, driving using a constant current is preferably not used, in order to reduce power consumption. In digital driving using a constant voltage, on the other hand, a transistor operates in a linear region, which can reduce an amount of power consumed by the transistor. (See WO 2005/116971)

In digital driving using a constant voltage, however, the same pixel needs to be accessed a multiple number of times during one frame period when a sub-frame is used, as each pixel has only a one-bit gradation capacity. This requires a high speed operation, thus making it difficult to attain gradation in high-resolution display. Also, in digital driving using a plurality of sub-frames having different light emission intensities, bit data needs to be written into a plurality of corresponding sub-pixels at a high speed. This makes it difficult to attain high resolution display.

In either manner of digital driving, the frequency at which to access a pixel increases with high resolution and gradation display, which increases the power consumption by the driving circuit. In particular, an increase of the display size results in an increase of power consumption by the driving circuit, and an increase of the frequency due to higher resolution display results in difficulty in reducing power consumption.

SUMMARY OF THE INVENTION

According to one aspect of the present invention, there is provided a display device which includes pixels arranged in a matrix, wherein each of the pixels can be driven in a digital manner or in an analog manner, and is driven in a time-divided fashion in a digital manner or in an analog manner.

Preferably, a data line can be provided for to each pixel array, and digital data and analog data for each pixel can be supplied to that data line in a time-divided manner.

Preferably, the digital data can include higher bits of brightness data of each pixel, and the analog data can include lower bits of brightness data of each pixel.

Preferably, input data can be digital data, and bits corresponding to digital driving can be temporarily stored in a memory, and thereafter read from the memory before being supplied to the data line, and bits corresponding to analog driving can be converted intact into analog data before being supplied to the data line.

Preferably, a display period for one frame, for each pixel, can be divided into a plurality of sub-frames, and a part of the sub-frames should be defined as a digital driving period, with other sub-frames being defined as an analog driving period.

According to the present invention, one pixel is driven in a time divided fashion in a digital manner or an analog manner. This makes it possible to perform efficient gradation display when driven in an analog manner, and perform display with lower power consumption when driven in a digital manner. This further makes it possible to perform display with lower power consumption even with high resolution display, using a relatively small number of sub-frames.

DESCRIPTION OF THE PREFERRED EMBODIMENTS

In the following, an embodiment of the present invention will be described based on the accompanying drawings.

Figure 1:
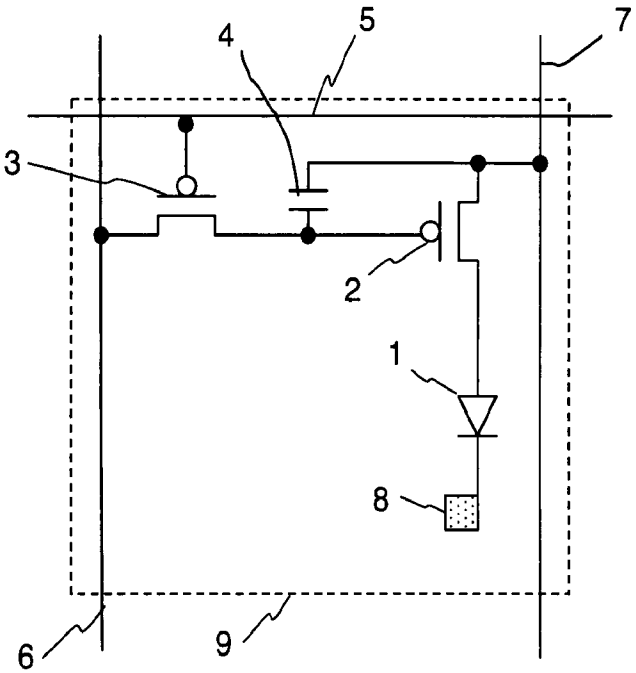
FIG. 1 is a diagram showing an example structure of a pixel circuit according to an embodiment.

FIG. 1 shows one example structure of a pixel 9. The pixel 9 includes an organic EL element 1, a p-type driving transistor 2, a p-type gate transistor 3, and a storage capacitance 4.

The source terminal of the driving transistor 2 is connected to the power supply line 7, and the drain terminal of the same is connected to the anode of the organic EL element 1. The gate terminal of the driving transistor 2 is connected to one end of the storage capacitance 4, as well as to the source terminal of the gate transistor 3. The storage capacitance 4 has another end connected to the power supply line 7, which is common to all pixels. The gate terminal of the gate transistor 3 is connected to the gate line 5, and the drain terminal of the same is connected to the data line 6. The cathode of the organic EL element 1 is connected to the cathode electrode 8, to which VSS is supplied, common to all pixels.

Upon selection of the gate line 5 (L level), the gate transistor 3 is turned on, and a signal supplied to the data line 6 is written into the storage capacitance 4. Thereupon, the driving transistor 2 is turned on, and a current flows into the organic EL element 1, with light emission resulting. In the above, based on the relation between the source-gate voltage and source-drain voltage of the driving transistor 2, the driving transistor 2 operates in either a saturation region (constant current driving) or a linear region (constant voltage driving).

Figure 2:
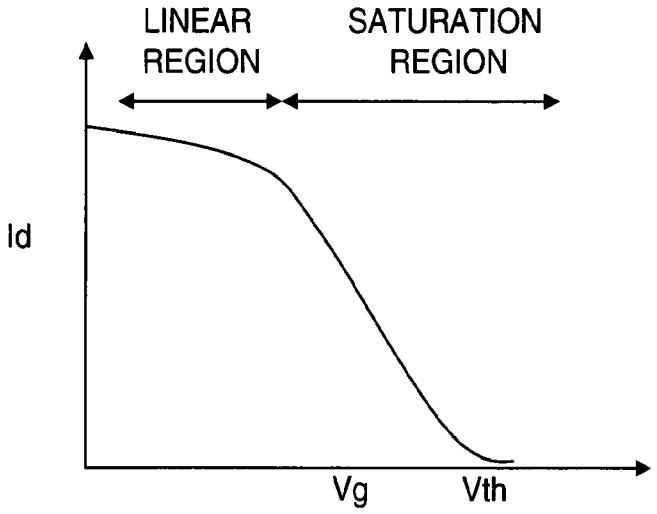
FIG. 2 is a diagram showing characteristic of a transistor.

FIG. 2 shows the relation between the gate potential Vg and drain current Id of the driving transistor 2. When the gate potential Vg gradually decreases and drops lower than Vth, the driving transistor 2 begins being turned on and operating in a saturation region. Resultantly, a constant current is produced. With the gate potential Vg further decreasing, the driving transistor 2 begins operating in the linear region, where the drain current ID varies less relative to the still decreasing gate potential Vg. That is, in the saturation region, as a small change in the gate potential Vg can produce a large change in the drain current Id, analog driving can be employed. That is, a gate potential Vg which causes the driving transistor to operate in the saturation region is supplied to the data line 6 while analog driving is carried out, and a gate potential Vg which causes the driving transistor 2 to operate in the linear region is supplied to the data line 6 while digital driving is carried out. In this manner, operation of the driving transistor 2 is controlled. In the linear region, however, only one current value can be obtained when a constant voltage is applied, and the driving transistor 2 is controlled through an on-off operation. Therefore, it is necessary to provide a sub-frame or the like to control the lighting period in order to attain multi-level tones, or gradation.

With the pixel 9 shown in FIG. 1, the maximum light emitting area for the organic EL element 1 can be ensured as the pixel 8 has a simple structure including only two transistors and one storage capacitance. This can improve reliability in extending the service life and preventing burning. However, a structure which employs current driving via the driving transistor 2 faces limitation in reducing power consumption as the driving transistor 2 consumes power, as well as a problem with brightness consistency within the plane due to variation in characteristics of the driving transistor 2.

A structure which employs digital driving through voltage driving, on the other hand, can reduce power consumption as the driving transistor 2 operates as a switch consuming no power. Moreover, the structure can attain preferable plane brightness consistency. However, the structure requires a sub-frame in order to attain multi-gradation, which makes the structure not readily applicable in following the current trend of higher resolution display and multi-gradation.

In view of the above, in this embodiment, like the pixel 9, a pixel adapted to both manners of driving, namely, constant current driving and constant voltage driving, is employed so that the advantages of both driving manners are combined to improve the overall performance.

Figure 3:
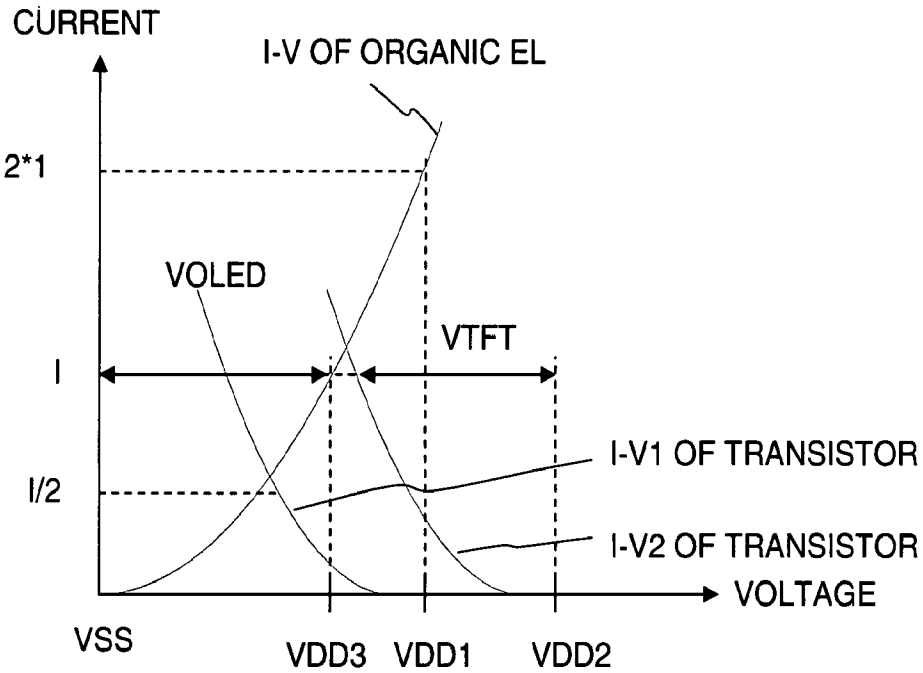
FIG. 3 is a diagram showing characteristic of an organic El and the transistor.

FIG. 3 shows current-voltage characteristics (I-V) of the organic EL element 1 and driving transistor 2 when driven using the driving method according to this embodiment, constant current driving (analog driving), and constant voltage driving (digital driving), respectively, in which the abscissas indicates a difference between the potentials supplied to the power supply line 7 and to the cathode electrode 8, and the ordinates indicates a current flowing from the power supply line 7 to the cathode electrode 8. Here, suppose that the pixel 9 needs a pixel current I. In this case, the potential VDD2 is supplied to the power supply line 7 when the required current is produced using only analog driving. In this case, the driving transistor 2 consumes a potential VTFT (source-drain potential of the driving transistor), and the organic EL element 1 consumes a potential VOLED (I-V2 of the transistor). Meanwhile, when digital driving is employed, the potential VTFT is substantially negligible, though a pixel current I flows, as the driving transistor 2 operates in a linear region. Therefore, the potential subsequently equal to the potential VOLED, or the potential used in driving the organic EL element 1, is sufficient as a potential to be supplied to the power supply line 7.

As described above, when the maximum current I is needed by the pixel 9, a voltage VDD3 or larger is required to be applied to the organic EL element 1 when analog driving is carried out. That is, a voltage VDD2 or larger is required to be applied to the power supply line 7 when analog driving alone is carried out in consideration of I-V (I-V2) of the driving transistor 2. When digital driving is carried out, on the other hand, a potential VDD3 (<VDD2) is sufficient as a potential to be supplied to the power supply line 7, as the driving transistor 2 is then in a full-on state and consumes no power.

In view of the above, considering that the required amount of current I is identical, it will be appreciated that power consumption can be reduced when digital driving is employed, a lower potential is needed as a power supply.

In this embodiment, a potential VDD1 (VDD3<VDD1<VDD2) is supplied to the power supply line 7. As a result, an amount of power smaller than that with analog driving, though higher than that with digital driving, is consumed.

With a voltage VDD1 lower than the voltage VDD2 applied to the power supply line 7, the range which permits the driving transistor 2 to operate in a saturation region is narrowed in consideration of I-V (I-V1) of the driving transistor 2. Accordingly, the amount of current produced with analog driving generally decreases. Here, suppose that the produced current is reduced to a half, or I/2. In this case, a voltage VDD1 is not sufficient to produce a desired amount of current I or brightness, using analog driving alone. Meanwhile, when the driving transistor 2 is driven in a digital manner, a current in the amount twice of I, or 2×I, can be produced with respect to the power source potential VDD1. In view of the above, theoretically, an arrangement in which analog driving is employed while a current up to I/2 flows into the organic EL element 1 and a digital manner is employed while a current larger than I/2 flows into the organic EL element 1 makes it possible to drive the pixel 1 so as to produce the maximum current 2×I while maintaining the power supply voltage as VDD1. According to this method, however, it is necessary to employ a large number of sub-frames when carrying out digital driving in order to ensure a sufficiently large number of gradations. In view of the above, according to this embodiment, one frame period is divided into the smallest possible plural number of sub-frame periods to control drive current, using both analog and digital driving.

Figure 4:
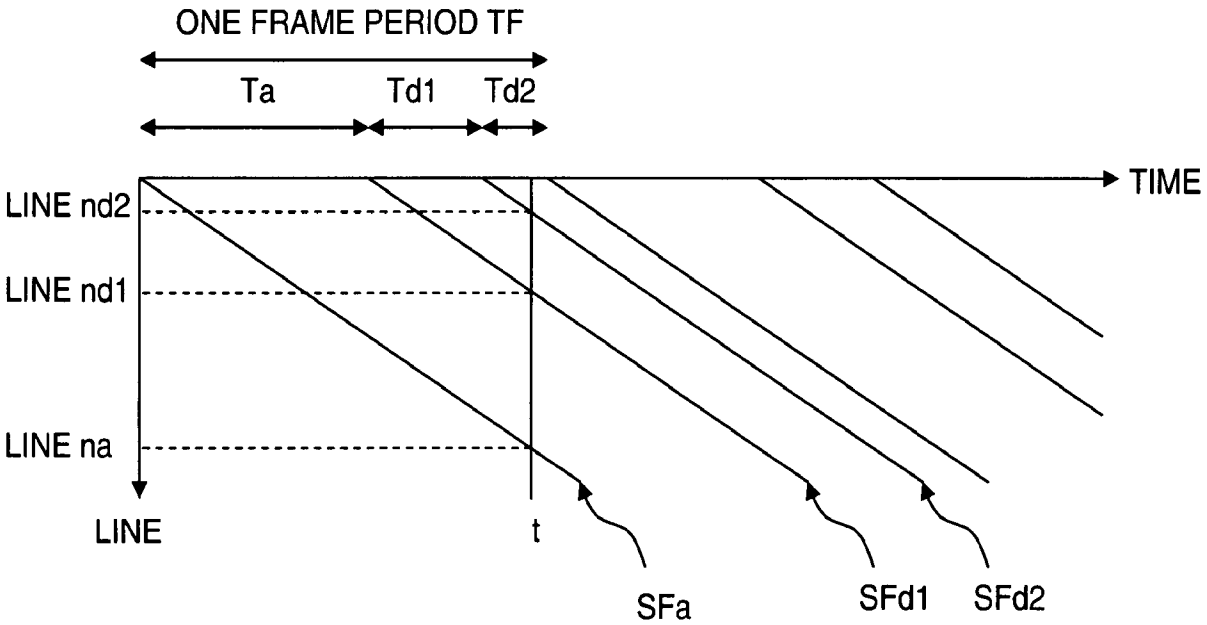
FIG. 4 is a diagram showing a sub-frame structure according to the embodiment.

FIG. 4 concerns a control method for an analog light emission period Ta and digital light emission period Td1, Td2, using sub-frames SFa, SFd1, SFd2. Initially, during the sub-frame SFa, analog signals are sequentially written into the pixel 9 from the top to bottom lines thereof. Specifically, for input data having six bits, for example, analog data is written into four less significant bits of the input data. Then, after elapse of the analog light emission period Ta, digital data about the most significant bit, or the fifth bit, is written into the pixel having the analog data already written therein, followed by digital data about the fourth bit thereof, upon which data writing in one frame is completed. With this arrangement in which a current corresponding to the two more significant bits is obtained with digital driving and that to the less significant bits is obtained with analog driving, it is possible to attain display with sufficient gradation, while only a smaller number of sub-frames are required and a relatively small amount of power is consumed. Alternatively, a current corresponding to the most significant bit alone or that to three more significant bits can be obtained with digital driving. It should be noted that, obviously, the order of sub-frames need not be limited to "analog driving to digital driving".

In the example shown in FIG. 4, a plurality of lines (line na, line nd1, line nd2) need to be selected at time t to write data into the respective lines. The data writing into the respective lines can be attained by way of time division selection, as described in WO 2005/116971. That is, a general selection period for one line is divided into three, and the respective lines are subjected to time division selection such that analog data, digital data about the fifth bit, and digital data about the fourth bit are written into the line na, line nd1, and line nd2, respectively.

Figure 5:
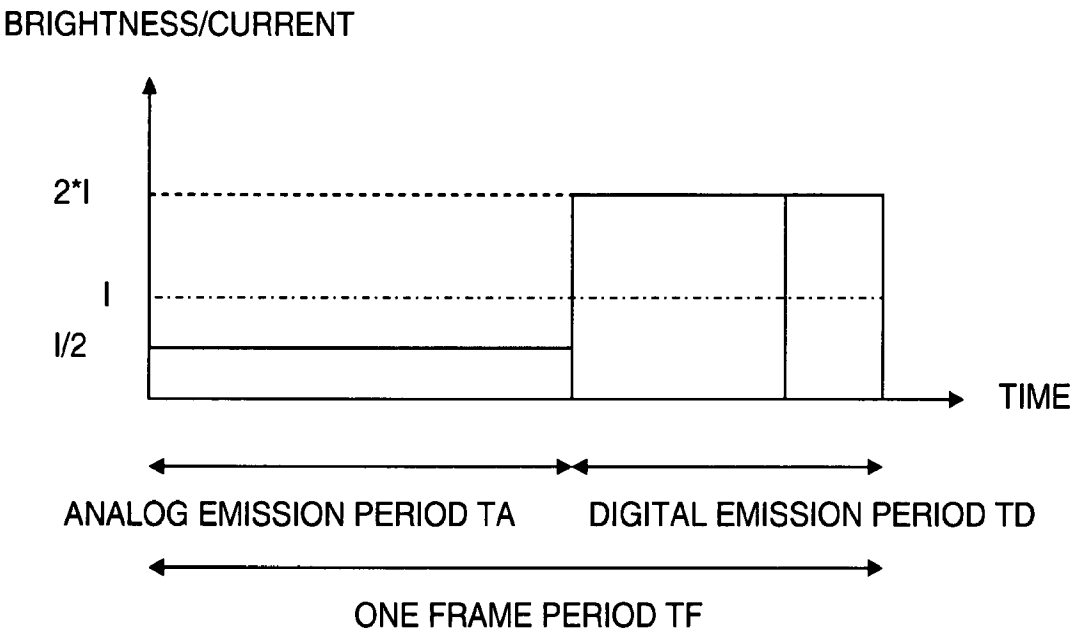
FIG. 5 is a diagram showing a state of light emission during one frame period.

FIG. 5 shows variation in brightness as time passes, which is controlled during one frame period for a certain line. When the potential VDD1 is set such that the maximum current I/2 is produced when analog driving is employed and the maximum current 2×I is produced when digital driving is employed, as shown in FIG. 3, brightness or a current shifts as time passes such that the maximum I/2 is produced in the analog light emission period Ta and the maximum 2×1 is produced in the analog light emission period Td, so that the desired amount of current I or brightness is produced by using respectively allocated light emission periods.

With the light emission periods Ta, Td more strictly set, then for input data of six bits, for example, analog light emission for four less significant bits thereof and digital light emission for two more significant bits thereof are achieved, as follows.

Specifically, for analog light emission for four less significant bits, the analog light emission period Ta can be defined as (30/63)*Tf as the maximum light emission intensity ratio allocated to analog light emission is 15/63. Accordingly, the maximum drive current results in (I/2)*(30/63)=(15/63)*I, which is identical to the above-described light emission intensity ratio. Meanwhile, the light emission period Td1 for the fifth bit is defined as (16/63)*Tf and the light emission period Td2 for the fourth bit is defined as (8/63)*Tf as the maximum light emission intensity ratio for the two more significant bits is 48/63. Accordingly, an on-current for the fifth bit results in 2*I*(16/63)=(32/63)*I and that for the fourth bit results in 2*I*(8/63)=(16/63) I, so that (48/63)*I can be produced in total. That is, with the sub-frames SFa, SFd1, SFd2 inserted so as to maintain Ta:Td1:Td2=30:16:8, desired light emission intensity and gradation can be attained with respect to the six-bit brightness data.

Here, when the amount of current produced with analog driving differs from that with digital driving, it is necessary to change the light emission periods accordingly. This can be achieved by re-setting the sub-frame periods Ta, Td1, Td2 as described above.

As described above, according to the present driving method, analog light emission contributes to substantially one quarter of the entire light emission, while digital light emission contributes to substantially three quarters thereof. Consequently, the inconsistent plane brightness which is very noticeable with analog driving becomes less noticeable in gradation achieved mainly with digital light emission. That is, the brightness consistency, which is better when the brightness is higher, is improved compared to the case where analog light emission is solely employed. In addition, the present driving method is readily applicable to a display with higher performance which is expected in the future, compared to the method employing solely digital driving, as analog light emission has the advantage in multi-gradation and high resolution display.

Figure 6:
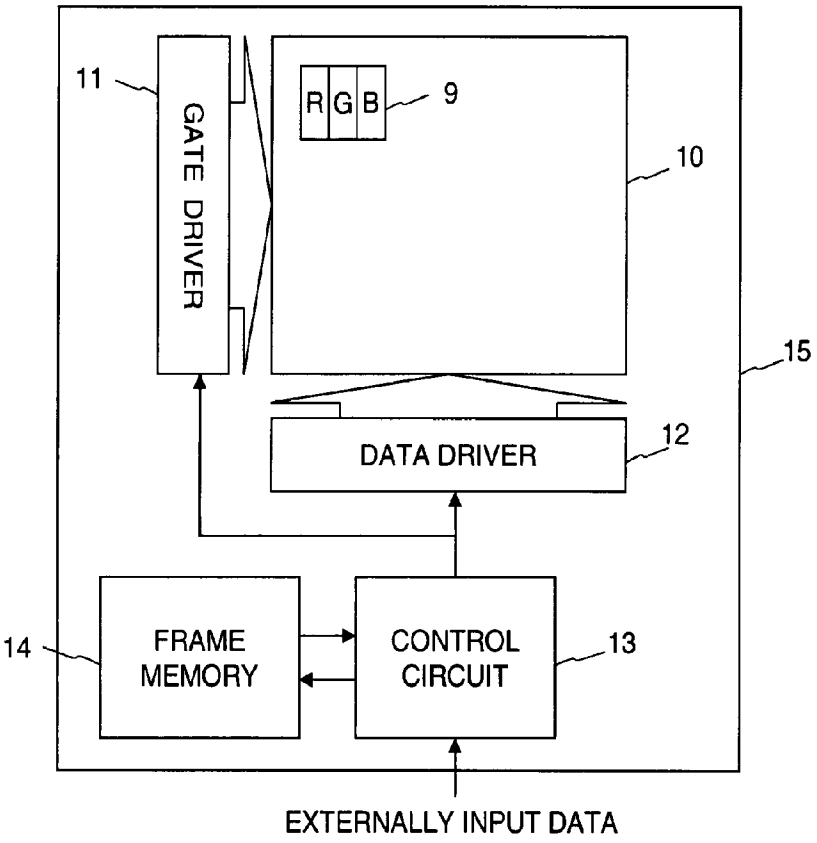
FIG. 6 is a diagram showing an entire structure of a display panel according to the embodiment.

FIG. 6 shows a complete structure of an organic EL display 15 which can realize the driving method according to the present invention. The organic EL display 15 includes a display array 10 in which pixels 9 are arranged in a matrix, a data driver 12 for supplying analog and digital data to the data line 6 to drive, a gate driver 11 for selecting and driving the gate line 5, a control circuit 13, and a frame memory 14. Each pixel 9 includes three RGB sub-pixels (dots).

Externally input six-bit input data, for example, is temporarily input to the control circuit 13, where data relating to two more significant bits thereof is input to the frame memory 14, and data relating to four less significant bits thereof is input to the data driver 12. In the data driver 12, data of the four less significant bits for dot transfer is accumulated in a line memory or the like to be converted into data in units of a line. Thereafter, at a time when a start pulse is input to the game driver 11 and then shifted, four-bit line data for one line is converted into analog data, and then output from the data driver 12 to all data lines 6.

As shown in FIG. 4, the sub-frame SFa for analog driving begins first, sequentially followed by the digital driving sub-frame SFd1 for the fifth bit, or the most significant bit, and the sub-frame SFd2 for the fourth bit, in this order. In the above, the bit data of the fifth and fourth bits are read from the frame memory 14 and transferred to the data driver 12.

In the above, while the data driver 12 receives sub-frame data of four less significant bits in each RGB dot (four bits), the data driver 12 receives sub-frame data of the fifth or fourth bit of each RGB dot. That is, in dot transfer to the data driver 12, only one bit is transferred at a time, which is quite inefficient. To address the above, the data driver 12 has a function for transferring one bit data for a plurality of pixels in parallel. With this function, transfer efficiency can be improved, compared to a case in which data is transferred in units of dots.

In the above, the input bus has at least four bits for each RGB pixel, as the less significant bits are of four bits. Thus, parallel transfer from the control circuit 13 to the data driver 12 can be utilized to input four-bit input for four pixels in parallel. With the above, data can be transferred four times faster from the control circuit 13 to the data driver 12.

Specifically, at the beginning of the sub-frames SFd1, SFd2 for digital driving, the data driver 12 remains in a parallel transfer mode so that line data of the fourth and fifth bits is transferred at a high speed to the data driver 12. The data driver 12 converts the received data of the four bits into data in units of a line before outputting to all data lines 6. It should be noted that the number of bits is not limited to the number of bits used in analog data transfer.

Using, as the gate driver 11, that disclosed in WO 2005/116971 selective writing into a plurality of lines can be appropriately carried out in a time divided manner, as carried out at time t in FIG. 4.

In FIG. 4, analog writing is carried out prior to digital writing so that the frame memory 14 having memory capacitance for only two more significant bits is applicable, though analog writing is not necessarily carried out prior to digital writing when the frame memory 14 has sufficient capacitance. In such a case, six-bit input data is temporarily held in the frame memory 14, for example, and data about the significant bits is read from the frame memory 14 to begin digital writing using the sub-frames SFd1, SFd2, and data of the four less significant bits is thereafter read from the frame memory 14 to begin analog writing using the sub-frame SFa.

It should be noted that the sub-frames for analog and digital driving can be switched, using a threshold correction circuit, such as is disclosed in WO 1998/048403, instead of using the pixel 9 shown in FIG. 1. The region where the driving transistor for driving an organic EL element operates can be switched between in a linear region and a saturation region, depending on the potential supplied to the data line and based on a similar principle to that described above. As variation in the degree of carrier movement of the driving transistor cannot be improved by using threshold correction alone, inconsistency results in a higher gradation area, though inconsistency in a lower gradation area can be corrected. Therefore, combination with the consistency in a higher gradation area, which is realized with the above-described digital driving, can improve consistency in brightness over the entire gradation area.

PARTS LIST

1 organic EL element
2 p-type driving transistor
3 p-type gate transistor
4 storage capacitance
5 gate line
6 data line
7 supply line
8 cathode electrode
9 pixel
10 display array
11 gate drive
12 data drive
13 control circuit
14 frame memory
15 organic EL display

The invention claimed is:

1. An organic EL display having a plurality of data lines, comprising:

(a) a display array having a plurality of organic EL pixels, each of which is connected to one of the plurality of data lines;

(b) a data driver for supplying analog and digital data to each of the plurality of data lines;

(c) a control circuit configured to:

receive digital input pixel data and divide the input pixel data into first data and second data, wherein the first data comprises brightness data for one or more least significant bits of each pixel, and the second data comprises brightness data for two or more most significant bits of each pixel;

wherein the first data is converted from a digital representation to an analog signal;

wherein the analog signal is driven during a first sub-frame; and wherein the second data is driven, one bit at a time, during two or more additional sub-frames, wherein the two or more additional sub-frames are either before the first sub-frame or after the first sub-frame.

2. The organic EL display of claim 1, additionally comprising a memory for storing the second data during the first sub-frame.

3. A method of driving an organic EL pixel, comprising:

(a) providing an organic EL pixel driven through a data line by a data driver;

(b) receiving digital input pixel data;

(c) dividing the input pixel data into first data and second data, wherein the first data comprises brightness data for one or more least significant bits of each pixel, and the second data comprises brightness data for two or more most significant bits of each pixel;

(d) converting the first data from a digital representation to an analog signal;

(e) dividing a frame period into three or more sub-frames;

(f) driving the analog signal during a fist sub-frame; and (g) driving the second data, one bit at a time, during two or more additional sub-frames, wherein the two or more additional sub-frames are either before the first sub-frame or after the first sub-frame.

4. The method of claim 3, additionally comprising:

storing the second data in a memory during the first sub-frame.

* * * * *